US007914333B2

(12) United States Patent
Verding

(10) Patent No.: US 7,914,333 B2
(45) Date of Patent: Mar. 29, 2011

(54) PLUG-IN ADAPTER

(75) Inventor: Markus Verding, Erben (DE); Rosemarie Angela Verding, legal representative, Erben (DE)

(73) Assignee: Siemens Aktiengesellschaft, Munich (DE)

( * ) Notice: Subject to any disclaimer, the term of this patent is extended or adjusted under 35 U.S.C. 154(b) by 543 days.

(21) Appl. No.: 11/547,496

(22) PCT Filed: Mar. 10, 2005

(86) PCT No.: PCT/EP2005/051096

§ 371 (c)(1), (2), (4) Date: Oct. 27, 2008

(87) PCT Pub. No.: WO2005/096446

PCT Pub. Date: Oct. 13, 2005

(65) Prior Publication Data

US 2009/0221185 A1 Sep. 3, 2009

(30) Foreign Application Priority Data

Apr. 2, 2004 (DE) ..... 10 2004 016 380

(51) Int. Cl.
*H01R 25/00* (2006.01)

(52) U.S. Cl. ..... 439/638; 439/676

(58) Field of Classification Search ..... 439/676, 439/79, 636–638

See application file for complete search history.

(56) References Cited

U.S. PATENT DOCUMENTS

| | | | | |
|---|---|---|---|---|
| 4,602,842 | A | 7/1986 | Free et al. | |
| 4,647,136 | A | 3/1987 | Kinoshita et al. | |
| 4,834,661 | A | 5/1989 | McMillian | |
| 4,934,947 | A | 6/1990 | Brummans et al. | |
| 6,325,674 | B1 | 12/2001 | Oliphant et al. | |
| 2004/0082228 | A1 * | 4/2004 | Chang | 439/676 |
| 2004/0087217 | A1 * | 5/2004 | Hyland et al. | 439/676 |
| 2004/0242077 | A1 * | 12/2004 | Chang | 439/676 |
| 2005/0130505 | A1 * | 6/2005 | Weng | 439/676 |

FOREIGN PATENT DOCUMENTS

| | | | |
|---|---|---|---|
| DE | 35 41 772 | A1 | 6/1986 |
| EP | 0 319 138 | A1 | 6/1989 |

* cited by examiner

*Primary Examiner* — Hien Vu

(57) ABSTRACT

A card edge connector allows a modular jack to be electronically connected to a PCMCIA Type III communications card. The card edge connector includes a modular jack with a main body portion having a top surface, a bottom surface, a front surface and a rear surface. A receptacle is disposed entirely within the front surface of the modular jack and the receptacle is sized and configured to receive a RJ series connector plug such that no portion of the plug extends through either the top surface or the bottom surface of the modular jack. A connector attached to the rear surface of the modular jack and the connector includes a socket sized and configured to receive a portion of a printed circuit board disposed within the communications card. Desirably, the card edge connector includes at least one contact pin including a plug engaging portion that extends into the receptacle and a printed circuit board engaging portion that extends into the socket.

11 Claims, 6 Drawing Sheets

PLUG-IN ADAPTER

CROSS REFERENCE TO RELATED APPLICATIONS

This application is the US National Stage of International Application No. PCT/EP2005/051096 filed Mar. 10, 2005 and claims the benefit thereof. The International Application claims the benefits of German application No. 102004016380.4 DE filed Apr. 2, 2004, both of the applications are incorporated by reference herein in their entirety.

FIELD OF INVENTION

The invention relates to a plug-in adaptor for establishing an electrical connection between contacts of a plug, which is fixed to the end of a cable, and contact surfaces of a patch panel, which are formed on the edge of a printed circuit board.

BACKGROUND OF INVENTION

To connect an electronic unit with a cable, to the end of which a plug is connected, to a printed circuit board, various contacting devices are known. If different types of plugs or the individual leads of the cable are to be connected directly, a corresponding multiway-design of connector is required on the printed circuit board.

When connecting a telecommunication system to the public telephone network it may be necessary, depending on local conditions, to form the connection by means of a type RJ-45 or by a screw terminal where the individual leads of the connecting cable are connected directly to the contact surfaces of the printed circuit board. In this case, an RJ-45 and a screw terminal must be provided on the printed circuit board. Moreover, it is often the case that with an ISDN communication system the connection between an SO port (digital exchange connection) and an external SO bus has to be reconfigured on site. To do so, two of the four connecting leads have to be crossed. The crossing takes place by means of a multiway connector provided on the printed circuit board or by manually reconfiguring the relevant contacting devices on site. The embodiment of the printed circuit board as a multiway connector of which only a certain part is actually used for the connection is expensive. The manual reconfiguring of the system on site can lead to faults.

SUMMARY OF INVENTION

An object of the invention is to create a plug-in adapter by means of which it is possible to connect plugs of various types to contact surfaces that are lead out to a patch panel on the edge of a printed circuit board.

This object is achieved by means of a plug-in adapter with the technical features of the claims. For advantageous embodiments of the invention, refer to the dependent claims.

According to the invention, a plug-in adapter comprising a base body, in which a first receiving chamber for the insertable reception of a plug and a second receiving chamber for the insertable reception of a patch panel are formed, is plugged into the patch panel of a printed circuit board. Contact bodies are provided in each receiving chamber. Corresponding contact bodies in the receiving chambers are electrically connected by connecting elements arranged in the base body. Depending on the design of the first receiving chamber, the patch panel of a printed circuit board can be connected to cable connectors of different types. By a corresponding design of the plug-in adapter, the connection can take place corresponding to a predetermined contact assignment, i.e. even where the connecting leads are crossed. Plug-in adapters in a type with crossed connecting leads can be color coded, so that the contact assignment can be clearly seen on the outside.

In a preferred embodiment, the plug-in adapter consists of two parts that can be manufactured using an injection molding tool that is of comparatively simple construction. In this case, the base body of the plug-in adapter consists of a first part in which the first receiving chamber is formed and a second part in which the second receiving chamber is formed. When correctly used, both parts are held in contact by locking means. With this design, the connecting elements are also formed in two parts and consist in each case of a first and second intermediate contact piece, with corresponding pieces being held in contact by the locking connection when mated.

A favorable construction with regard to the connecting technique is characterized in that the plug-in opening of the first and of the second receiving chamber are each arranged on opposite side surfaces of the rectangular plug-in adapter.

In a preferred embodiment, the first receiving chamber is formed to be RJ-compatible. The second receiving chamber has a rectangular inner space formed for the insertable reception of the patch panel and has fork-shaped contact springs arranged side by side and aligned in the insertion direction.

In a further embodiment of the invention, it is preferred if grooves are formed in the inner wall surfaces that face the plane of the patch panel. The contact springs are arranged in these grooves. Each groove forms a compartment for a leg of a contact spring. This prevents contact between adjacent contact springs when the patch panel is plugged in.

It is favorable if the contact springs are embodied with respect to material and shape so that in the inserted position the patch panel is held between the legs of the contact springs by spring force. In this way, the plug-in adapter is secured to the printed circuit board by friction force.

In order to achieve a particularly stable attachment of the plug-in adapter to the printed circuit board, it is advantageous to form the webs between the grooves in such a way that the web surfaces that face towards the printed surface board are tapered when viewed in the insertion direction.

A particularly preferred embodiment of the invention is characterized in that the first receiving chamber is formed as four-pole, plug-in socket, with two adjacent contact tongues being crossed over to connect with corresponding contact springs in the second receiving chamber.

Preferably, both parts of the base body are manufactured using injection molding technology by the injection molding of flame-resistant polymer material.

For mass production, it can also be favorable if the base body is manufactured in a single work operation from plastic using a suitably formed injection molding tool, with each connecting element also consisting of a single-piece stamped-bent part.

To achieve particularly reliable contact, it is advantageous if the contact springs are coated with a corrosion-resistant metal coating, particularly with a gold alloy.

BRIEF DESCRIPTION OF DRAWINGS

The invention is explained in the following by means of examples with reference to the accompanying drawings, in which.

DETAILED DESCRIPTION OF INVENTION

Figure 1:
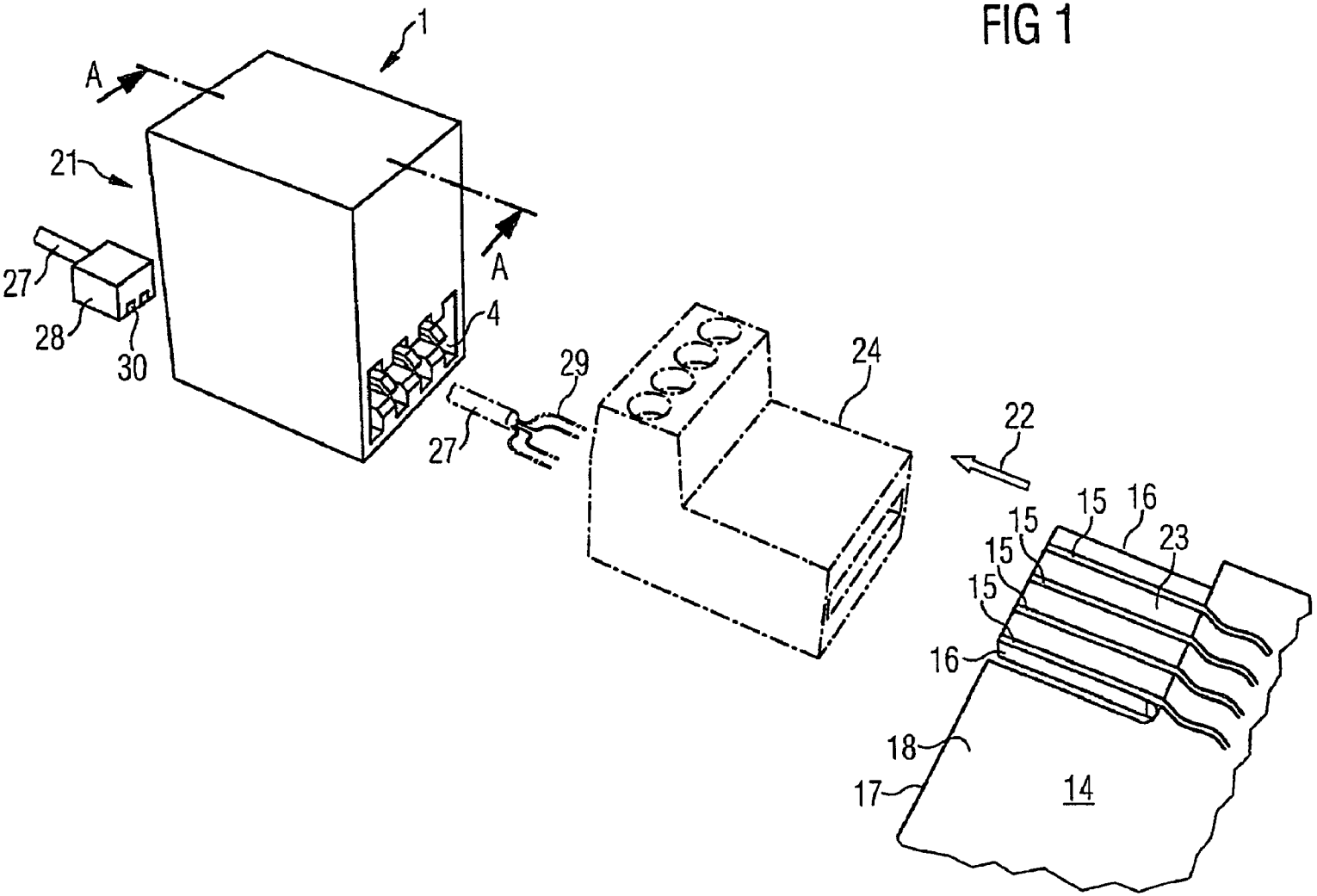
FIG. 1 shows a general perspective view of a printed circuit board with a patch panel that can alternatively be connected to leads of a cable by means of a screw terminal by or to a plug fitted to the end of the cable by means of the plug-in adapter according to the invention.
Figure 2:
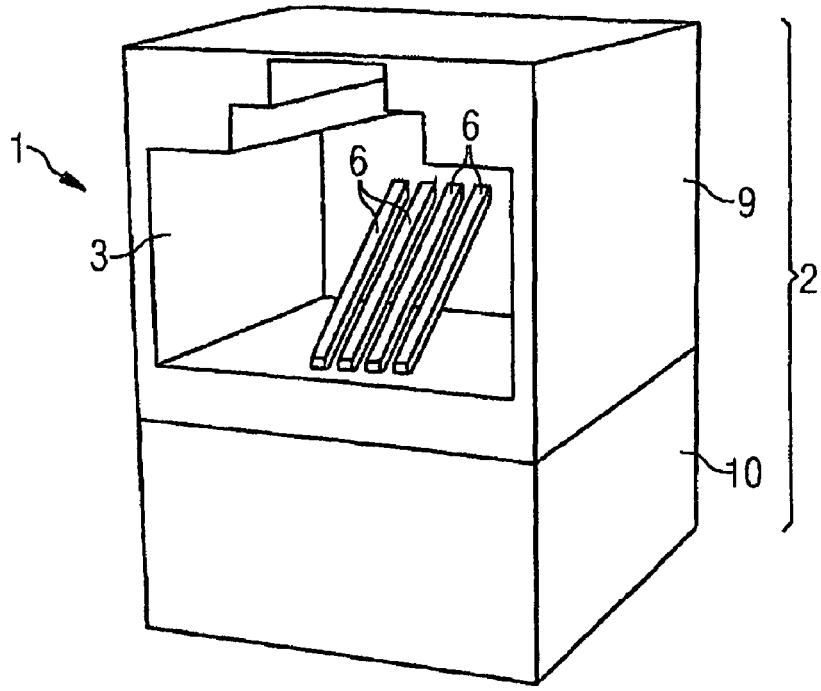
FIG. 2 shows a perspective view of a first form of embodiment of the plug-in adapter according to the invention, viewed in the direction of the first receiving chamber.

FIG. 1 shows a perspective view of a printed circuit board 14 on the edge 18 of which a patch panel is formed. Contact tracks lead into the patch panel 23 and terminate there in contact surfaces 15 lying parallel to each other. The patch panel 23 is limited at the sides by recesses 16 and terminates at the front flush with the circuit board edge 17. To connect a cable 27, to the end of which a plug 28 is fitted, to the printed circuit board 14, the plug 28 of the cable 27 is plugged into a first receiving chamber 3 (FIG. 2) and the patch panel 23 is plugged into a second receiving chamber 4 (FIG. 1) of the plug-in adapter 1 according to the invention. Both receiving chambers 3 and 4 are located on opposite side surfaces of the rectangular plug-in adapter 1. The electrical connection between the contacts 30 of the plug 28 and the contact surfaces 15 of the printed circuit board 14 is by means of connecting elements that are arranged in the base body of the plug-in adapter 1. Further details of the design of the connecting elements are given in the following. If the individual leads 29 of a cable 27 are to be connected to the patch panel 23 of the printed circuit board 14, this can be achieved in the conventional manner by means of a screw terminal 24. A screw terminal 24 of this kind is shown in FIG. 1 by a broken line. The screw terminal 24 also has a receiving chamber into which the patch panel 23 is inserted as shown by the arrow 22. The patch panel 23 can thus be connected either by means of a plug-in connection (plug-adapter 1 and plug 28) or directly by means of the terminal connection (screw terminal 24 and leads 29) to the cable 27. A first form of embodiment of the plug-in adapter 1 according to the invention is shown in more detail in a four-pole type in FIGS. 2 to 5. The plug-in adapter 1 consists of two parts, a first part 9 and a second part 10. Both parts 9 and 10 form a rectangular base body 2. FIG. 2 is a perspective view in the direction of the first receiving chamber 3, arranged according to IEC 603-7 , i.e. to provide a contact with contacts 30 of the plug 28, the contact body consists of 4 parallel contact tongues 6 that extend in an approximately diagonal direction into the receiving chamber 3.

Figure 3:
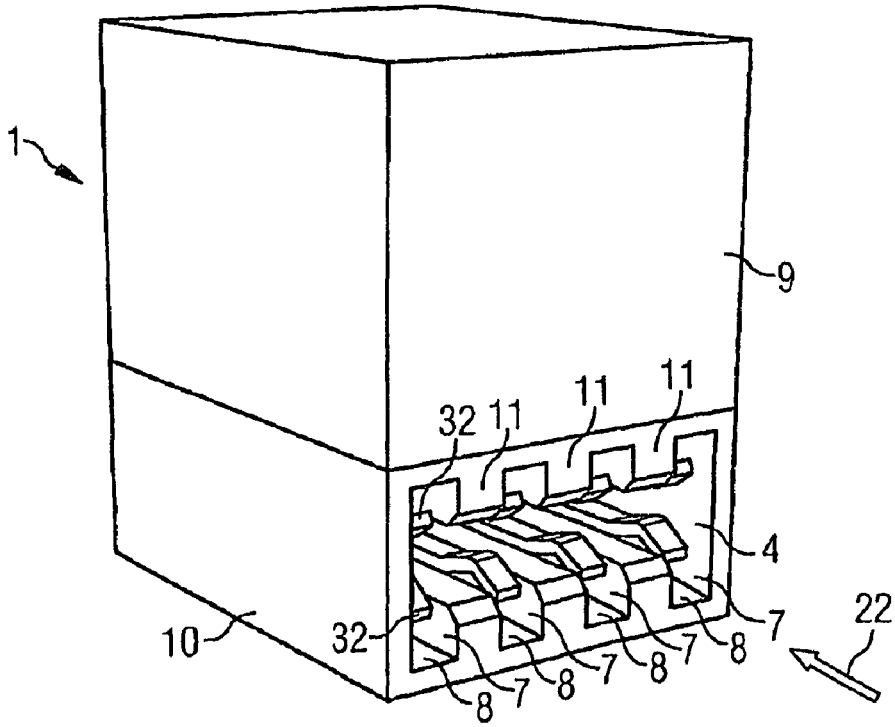
FIG. 3 shows a perspective view of the first form of embodiment viewed in the direction of the second receiving chamber.

FIG. 3 is a view of the plug-in adapter 1 in the direction of the second receiving chamber 4. The second receiving chamber 4 is formed in the second part 10 of the base body and has an approximately rectangular inner space. The inner surfaces of the inner space facing towards the printed circuit board are provided with grooves 8. The grooves 8 lie parallel to each other and extend in the insertion direction 22. Groove webs 11 forming a type of comb in the inner space can be seen between the grooves 8. Pairs of opposing grooves 8 each form a receiving space for a contact spring 7. The contact springs 7 are forked-shaped. Opposing grooves 8 each form a compartment for a leg 32 of a contact spring 7.

Figure 4:
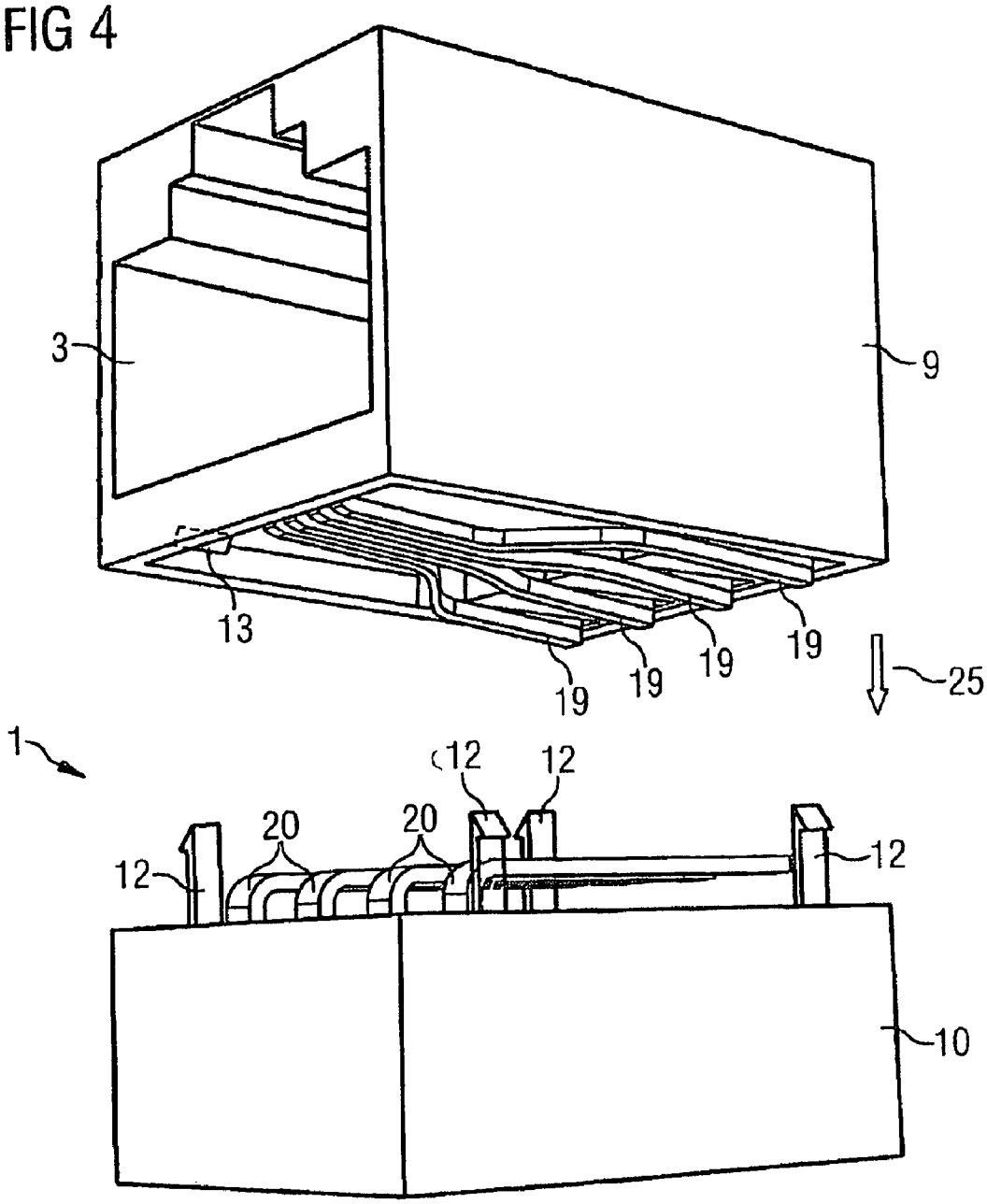
FIG. 4 shows a perspective view of the first form of embodiment showing the first part lifted off from the second part, in an oblique view from below in the direction of the intermediate contacts of the first part.
Figure 5:
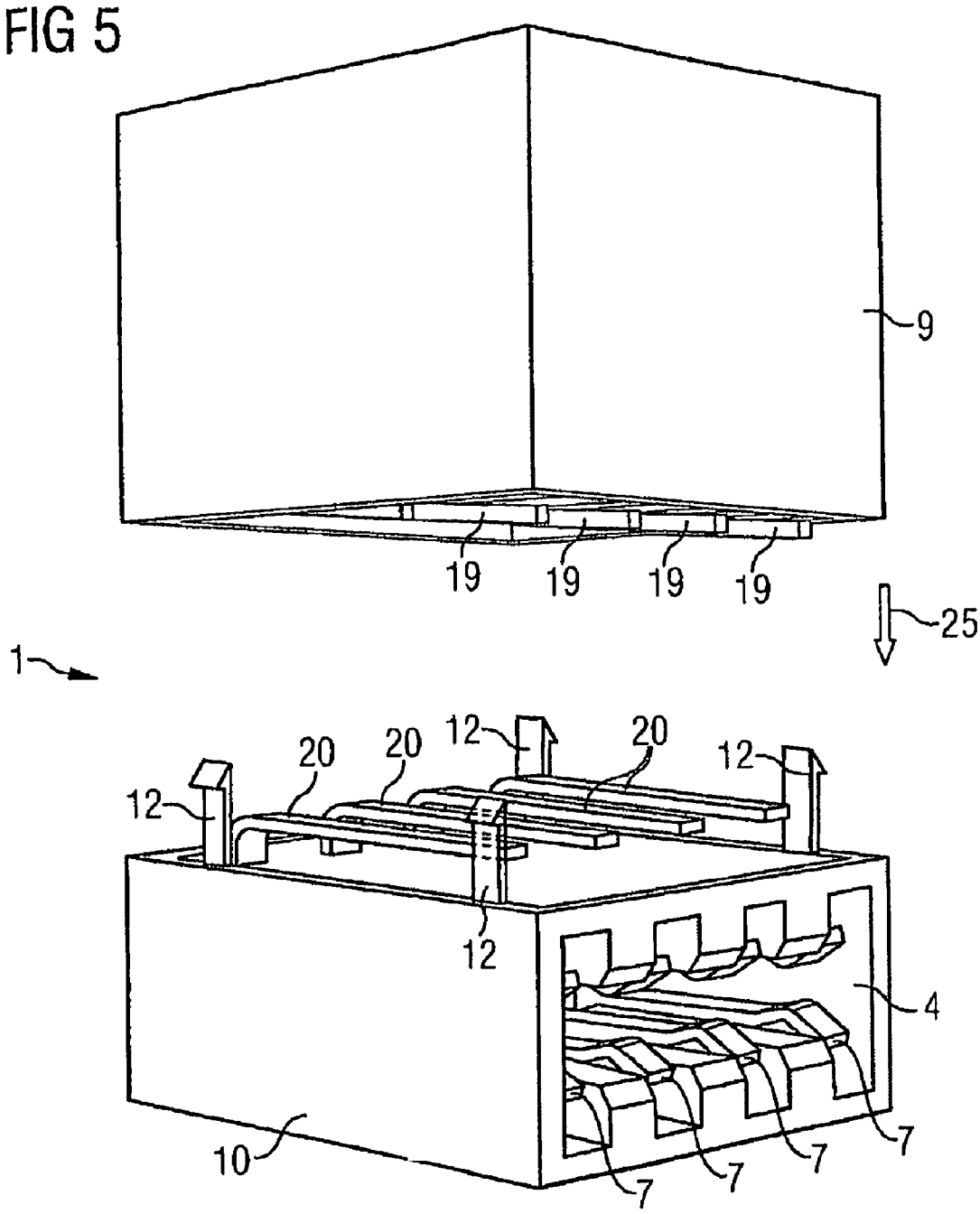
FIG. 5 shows a perspective view of the first form of embodiment also showing the first part lifted off from the second part, in an oblique view from above in the direction of the intermediate contacts of the second part.

FIGS. 4 and 5 are perspective views showing the first form of embodiment of the plug-in adapter 1 according to the invention, with both parts 9 and 10 being shown lifted off. As can be seen from FIG. 4, the contact bodies in the first receiving chamber 3 each continue to a top intermediate contact piece 19. Similarly, the contact springs 7 in the second receiving chamber 4 are formed to the bottom intermediate contact piece 20. If the top part 9 is now placed on the bottom part 10 in the direction of the arrow 25, the locking elements 12 engage in the corresponding locking openings 13 of the top part 9, with corresponding intermediate contacts 19 or 20 being held in contact.

Figure 6:
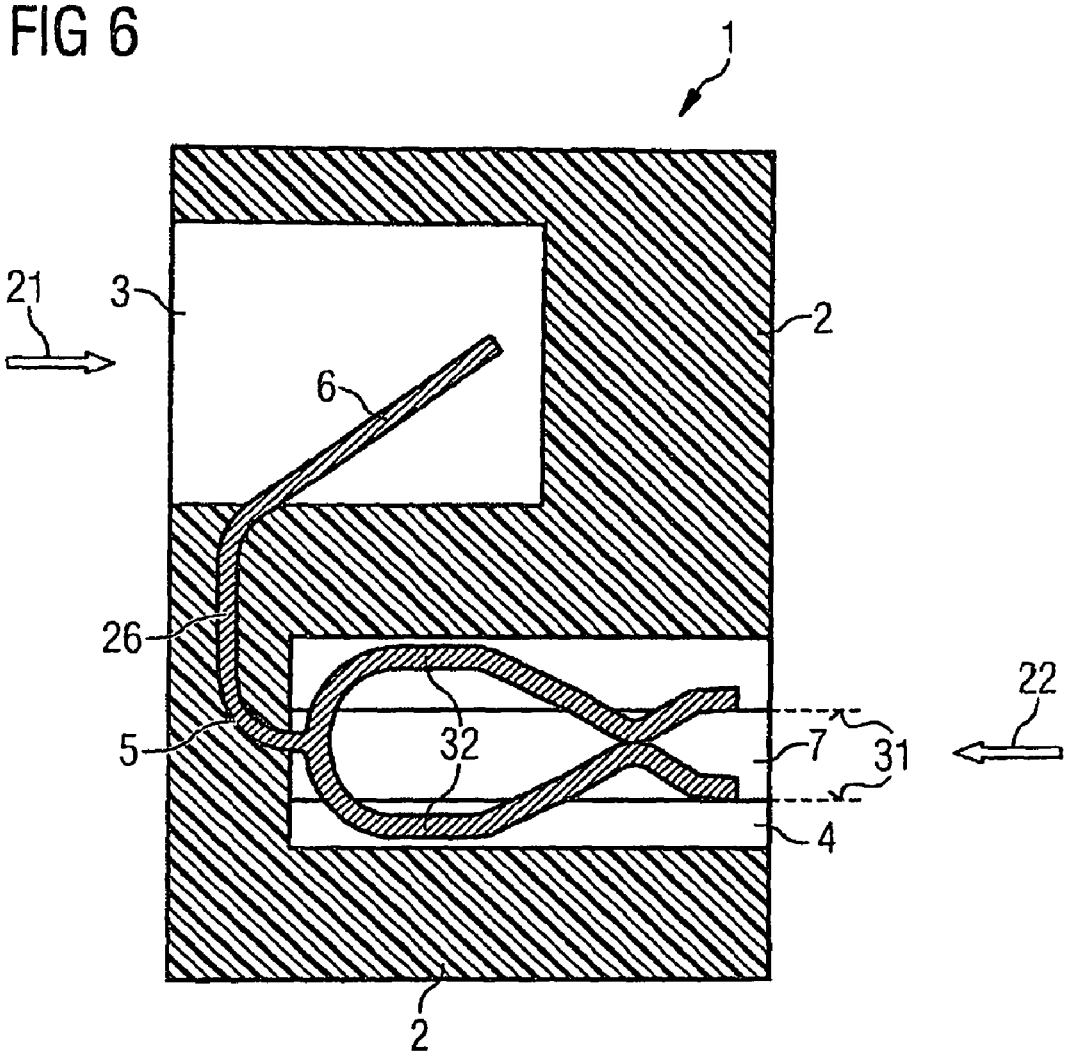
FIG. 6 shows a second embodiment of the plug-in adapter in accordance with the invention showing a sectional view along line A-A in FIG. 1.

FIG. 6 is a section view along line A-A in FIG. 1 of a second embodiment of the plug-in adapter 1 according to the invention. This embodiment of the plug-in adapter 1 is single-piece construction. It consists of a base body 2 produced in a single piece by injection molding. The connecting elements 5 are also single-piece and manufactured from a single piece of material as a bent-stamped part. A connecting section 26 of each connecting element 5 is furthermore embedded in polymer material. The connecting section 26 that connects the contact tongues 6 in the first receiving chamber 3 with the contact springs 7 in the second receiving chamber 4 [lacuna]. In this embodiment also, the contact springs 7 are located in grooves.

As shown above, opposing surfaces of groove webs 31 can also be tapered when viewed in the insertion direction 32, to improve the mechanical retention.

Figure 7:
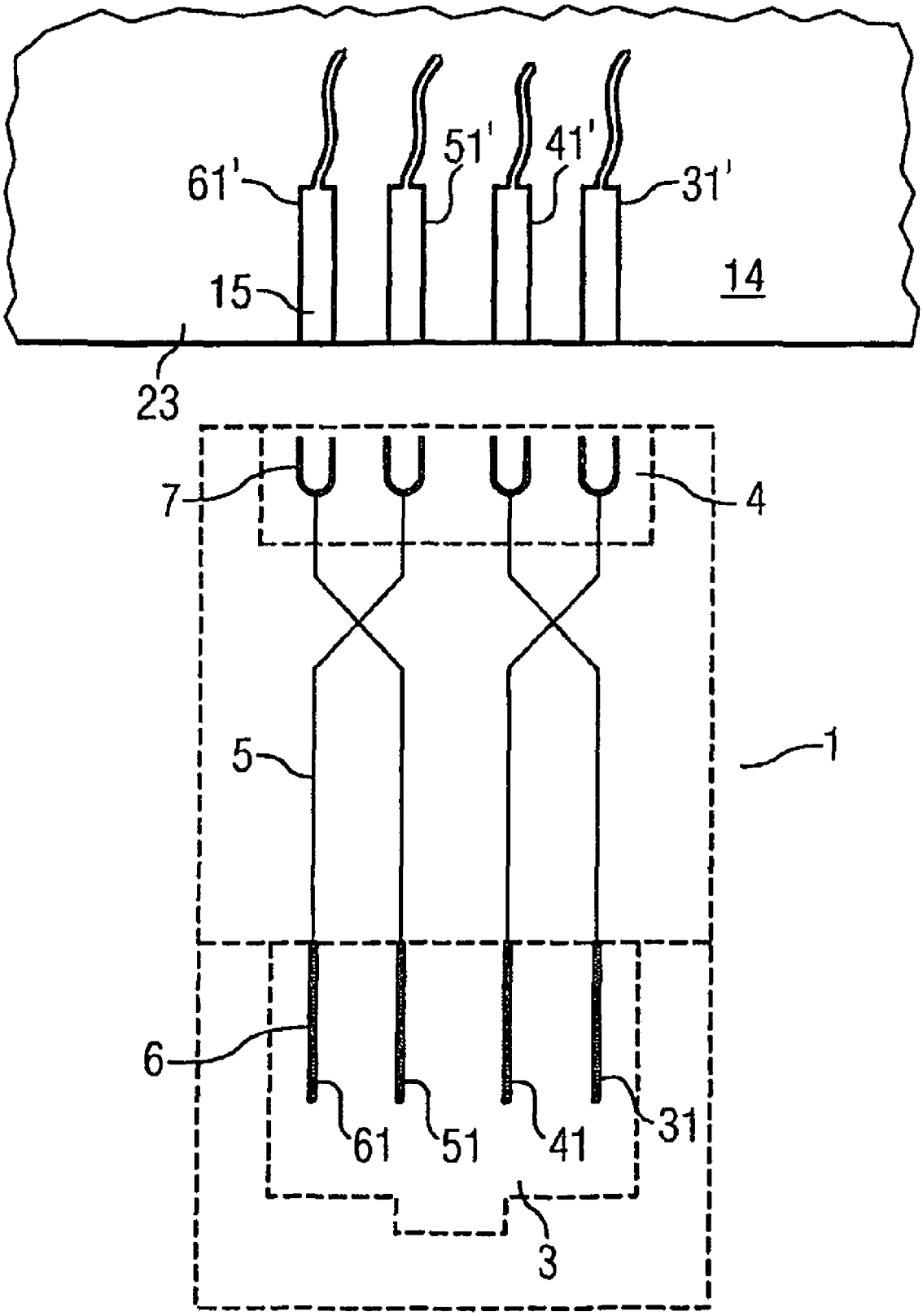
FIG. 7 shows a circuit diagram of the contact assignment of a four-pole, plug-in adapter according to the invention, with two adjacent connecting leads being crossed.

FIG. 7 shows a circuit diagram of a third embodiment of the invention that is particularly preferred for use when connecting a telecommunication device. The illustration is a schematic view of a plug-in connector 1, the receiving chamber 4 at the plug end of which is formed to receive a four-pole RJ-compatible plug. As already shown in the introduction, problems frequently occur when connecting a telecommunications system, in that the printed circuit board connection not only has to be designed alternatively as a plug-in or screw terminal but also must be able to be configured both for an external SO and an internal SO terminal, i.e. the adjacent leads have to be crossed. In this embodiment, this problem is solved in that in the plug-in adapter 1 according to the invention two adjacent connecting elements 5 are formed crossed over. As can be seen in the circuit diagram in FIG. 7, the contact tongues 61 of the first receiving chamber 4 are not connected to the corresponding contact tongues 61' of the patch panel 23 of the printed circuit board 14 but instead to the contact surface 51'; equally, the contact tongue 51 is not connected to the corresponding contact surface 51' but instead crossed over to connect to the contact surface 61'. It is particularly advantageous in this case if on the plug adapter 1 it can be clearly seen on the outside, for example by color coding, whether the connecting elements 5 are crossed or not crossed.

The invention claimed is:

1. A plug-in adapter for establishing an electrical connection between contacts of a plug connected to a cable and contact surfaces of a patch panel formed on the edge of a printed circuit board, comprising:

a first body having a top, a bottom, a front side, a rear side, and a first receiving chamber being defined in one of the front side and rear side of the first body, the bottom of the first body defining a bottom aperture, the first body also having a plurality of locking recesses positioned adjacent to the bottom aperture such that a plurality of lock elements are receivable within the plurality of locking recesses;

a second body having a top, a bottom, a front side, and a rear side, a second receiving chamber being defined in one of the front side and the rear side of the first body, the second body also having the plurality of lock elements positioned adjacent to the top of the second body that extend outward therefrom;

a plurality of first contact bodies, each one of the plurality of first contact bodies having a contact tongue and a top intermediate contact piece;

a plurality of second contact bodies, each one of the plurality of second contact bodies having a bottom intermediate contact piece and a forked-shaped contact spring, the forked-shaped contact spring having an upper leg and a lower leg defining an opening for providing a connection with the printed circuit board; and wherein the contact tongue of the plurality of first contact bodies is located inside the first receiving chamber, such that the top intermediate contact piece is located adjacent to the bottom aperture and extended along and parallel to the bottom aperture; and wherein the contact spring of the plurality of second contact bodies is located inside the second receiving chamber, the bottom intermediate contact piece located adjacent to the top of the second body and extended along and parallel to the top of the second body;

wherein the first body and the second body are connected in a mated condition by inserting the plurality of locking elements into the plurality of locking openings; and wherein the top intermediate contact piece contacts the bottom intermediate contact piece and forms an electrical connection when the first body and the second body are in the mated condition;

wherein the first body and the second body are formed from an injection molded fire-resistant polymer material.

2. The plug-in adapter as claimed in claim 1, wherein the first body and the second body are rectangular; and wherein the first receiving chamber and the second receiving chamber are each arranged on opposite sides of the first body and the second body.

3. The plug-in adapter as claimed in claim 1, wherein the first receiving chamber is RJ-compatible; and wherein the plurality second contact bodies are arranged alongside each other, the opening of the fork-shaped contact spring facing towards an opening of the second receiving chamber defined in the rear side or the front side of the second body.

4. The plug-in adapter as claimed in claim 3, wherein the second receiving chamber has a top inner surface, a bottom inner surface, the top inner surface and the bottom inner surface both having a plurality of longitudinal grooves; and wherein the plurality of second contact bodies are arranged in the plurality of longitudinal grooves of the top inner surface and the bottom inner surface, the opening of the fork-shaped contact spring facing towards an opening of the second receiving chamber.

5. The plug-in adapter as claimed in claim 4, wherein each contact spring is embodied such that in a mated position the patch panel is held by a spring force between the upper leg and the lower leg of the fork-shaped contact spring.

6. The plug-in adapter as claimed in claim 5, wherein a plurality of groove webs are defined between the plurality of longitudinal grooves of the top inner surface and the bottom inner surface, the plurality of groove webs being tapered when viewed from an opening of the second receiving chamber.

7. The plug-in adapter as claimed in claim 6, wherein the plurality of first contact bodies comprises a first pair and a second pair of contact bodies arranged adjacent to each other; and wherein the plurality of second contact bodies comprises a first pair and a second pair of contact bodies that are arranged adjacent to each other; and wherein the first pair and the second pair of first contact bodies have a first pair and a second pair of top intermediate contact pieces, respectively; and wherein the first pair and the second pair of second contact bodies have a first pair and a second pair of bottom intermediate contact pieces, respectively; and wherein the first pair of top intermediate contact pieces correspond to the first pair of bottom intermediate contact pieces, and the second pair of top intermediate contact pieces correspond to the second pair of bottom intermediate contact pieces; and wherein one of the top intermediate contact pieces of the first pair of top intermediate contact pieces is electrically connected to an opposite bottom intermediate contact piece of the first pair of bottom intermediate contact pieces, and the other top intermediate contact piece of the first pair of top intermediate contact pieces is electrically connected to the other bottom intermediate contact piece of the first pair of bottom intermediate contact pieces when the first and the second body are in a mated condition; and wherein one of the top intermediate contact pieces of the second pair of top intermediate contact pieces is electrically connected to an opposite bottom intermediate contact piece of the second pair of bottom intermediate contact pieces, and the other top intermediate contact piece of the second pair of top intermediate contact pieces is electrically connected to the other bottom intermediate contact piece of the second pair of bottom intermediate contact pieces when the first body and the second body are in the mated condition.

8. The plug-in adapter as claimed in claim 6, wherein the plurality of first contact bodies and the plurality of second contact bodies are coated with corrosion-resistant coatings.

9. The plug-in adapter as claimed in claim 8, wherein the plurality of first contact bodies and the plurality of second contact bodies are coated with a gold alloy.

10. The plug-in adapter as claimed in claim 6, wherein each one of the plurality of first contact bodies and each one of the plurality of second contact bodies are formed as a stamped-bent part.

11. The plug-in adapter as claimed in claim 1, wherein the first body and the second body are manufactured from an injection molded polymer material, and the plurality of first contact bodies and the plurality of second contact bodies are embedded in polymer material.

* * * * *